US006170090B1

(12) United States Patent
Minor

(10) Patent No.: US 6,170,090 B1
(45) Date of Patent: Jan. 9, 2001

(54) HARD HAT

(76) Inventor: James Minor, 113 Burnmaster St., Bellechasse, LA (US) 70056

( * ) Notice: Under 35 U.S.C. 154(b), the term of this patent shall be extended for 0 days.

(21) Appl. No.: 09/527,337

(22) Filed: Mar. 17, 2000

(51) Int. Cl.[7] ..... A42B 3/00
(52) U.S. Cl. ..... 2/411; 2/416; 2/171.3
(58) Field of Search ..... 2/410, 411, 416, 2/422, 424, 7, 171.3, 171.4

(56) References Cited

U.S. PATENT DOCUMENTS

| | | | | |
|---|---|---|---|---|
| 4,035,847 | * | 7/1977 | Prince et al. | 2/416 |
| 4,463,456 | * | 8/1984 | Hanson | 2/416 |
| 4,521,831 | * | 6/1985 | Thayer | 362/32 |
| 4,731,885 | * | 3/1988 | Nava | 2/424 |
| 4,744,106 | | 5/1988 | Wang | 2/171.3 |
| 4,852,562 | | 8/1989 | Howie | 128/201.25 |
| 4,893,356 | | 1/1990 | Waters | 2/171.3 |
| 4,995,117 | * | 2/1991 | Mirage | 2/410 |
| 5,085,231 | | 2/1992 | Johnson | 131/329 |
| 5,212,843 | * | 5/1993 | Kamata | 2/424 |
| 5,394,566 | * | 3/1995 | Hong | 2/424 |
| 5,425,620 | | 6/1995 | Stroud | 416/63 |
| 5,561,862 | | 10/1996 | Flores, Sr. | 2/171.3 |
| 5,588,736 | * | 12/1996 | Shea, Sr. | 362/106 |
| 5,931,559 | * | 8/1999 | Pfaeffle | 362/106 |

* cited by examiner

*Primary Examiner*—Michael A. Neas
(74) *Attorney, Agent, or Firm*—Joseph N. Breaux

(57) ABSTRACT

A hard hat that includes a number of user adjustable air vents to allow the user to adjust the volume of air flow through the hard hat to provide a cooling effect to the head of the wearer. The hard hat is constructed from phosphorescent plastic so that the glow from the hard hat could alert fellow workers of the position of the wearer of the hat in dark ambient light conditions.

1 Claim, 3 Drawing Sheets

HARD HAT

TECHNICAL FIELD

The present invention relates to construction safety equipment and more particularly to a hard hat that includes a molded, hard, phosphorescent plastic hat shell, a hat shell support harness, and a number of user adjustable air flow vent assemblies; the hat shell having a rim surrounding a domed shaped head cover portion having a head receiving cavity formed therein for receiving a head of a user, a number of vent cut outs formed therethrough and spaced around a bottom perimeter edge thereof adjacent to the rim; the hat shell support harness including a head crown covering harness secured to an interior surface of the head cover portion that defines the head receiving cavity and a pair of length adjustable chin straps for securing around the chin of a wearer to prevent the hard hat from being knocked off; each of the number of user adjustable air flow vent assemblies being installed within one of the number of vent cutouts of the head cover portion; each user adjustable air flow vent assembly including a front vent plate and a slidable vent closure member; each front vent plate being rigidly secured to an exterior surface of the head cover portion and having a number of spaced air flow openings formed therethrough, a vent closure adjustment knob slot formed therethrough, two L-shaped vent closure member retaining slide brackets extending from an upper edge, back surface thereof, and two L-shaped vent closure member retaining slide brackets extending from a lower edge, back surface thereof; each slidable vent closure member having a plate portion slidably entrapped in connection with the front vent plate by the four L-shaped closure member retaining brackets and having a number of spaced closure plate air flow openings spaced and numbered to correspond with the spaced air flow openings of the front vent plate, and an adjustment knob extending outwardly from the plate portion through t he vent closure adjustment knob slot; the adjustment knob being movable between a first position wherein the closure plate air flow openings are completely aligned with the sp aced airflow openings of the front vent plate and a second position wherein the closure plate air flow openings are completely out of alignment with the spaced airflow openings of the front vent plate.

BACKGROUND ART

Hard hats can protect construction workers and the like from serious injuries. Although hard hats provide effective head protection, they can often become uncomfortably warm. It would be a benefit, therefore, to have a hard hat that included a number of user adjustable air vents to allow the user to adjust the volume of air flow through the hard hat to provide a cooling effect to the head of the wearer. Because hard hats must be worn day or night, it would be a further benefit to have a hard hat that was constructed from phosphorescent plastic so that the glow from the hard hat could alert fellow workers of the position of the wearer of the hat in dark ambient light conditions.

GENERAL SUMMARY DISCUSSION OF INVENTION

It is thus an object of the invention to provide a hard hat that includes a molded, hard, phosphorescent plastic hat shell, a hat shell support harness, and a number of user adjustable air flow vent assemblies; the hat shell having a rim surrounding a domed shaped head cover portion having a head receiving cavity formed therein for receiving a head of a user, a number of vent cut outs formed therethrough and spaced around a bottom perimeter edge thereof adjacent to the rim; the hat shell support harness including a head crown covering harness secured to an interior surface of the head cover portion that defines the head receiving cavity and a pair of length adjustable chin straps for securing around the chin of a wearer to prevent the hard hat from being knocked off; each of the number of user adjustable air flow vent assemblies being installed within one of the number of vent cutouts of the head cover portion; each user adjustable air flow vent assembly including a front vent plate and a slidable vent closure member; each front vent plate being rigidly secured to an exterior surface of the head cover portion and having a number of spaced air flow openings formed therethrough, a vent closure adjustment knob slot formed therethrough, two L-shaped vent closure member retaining slide brackets extending from an upper edge, back surface thereof, and two L-shaped vent closure member retaining slide brackets extending from a lower edge, back surface thereof; each slidable vent closure member having a plate portion slidably entrapped in connection with the front vent plate by the four L-shaped closure member retaining brackets and having a number of spaced closure plate air flow openings spaced and numbered to correspond with the spaced air flow openings of the front vent plate, and an adjustment knob extending outwardly from the plate portion through the vent closure adjustment knob slot; the adjustment knob being movable between a first position wherein the closure plate air flow openings are completely aligned with the spaced airflow openings of the front vent plate and a second position wherein the closure plate air flow openings are completely out of alignment with the spaced airflow openings of the front vent plate.

Accordingly, a hard hat is provided. The hard hat includes a molded, hard, phosphorescent plastic hat shell, a hat shell support harness, and a number of user adjustable air flow vent assemblies; the hat shell having a rim surrounding a domed shaped head cover portion having a head receiving cavity formed therein for receiving a head of a user, a number of vent cut outs formed therethrough and spaced around a bottom perimeter edge thereof adjacent to the rim; the hat shell support harness including a head crown covering harness secured to an interior surface of the head cover portion that defines the head receiving cavity and a pair of length adjustable chin straps for securing around the chin of a wearer to prevent the hard hat from being knocked off; each of the number of user adjustable air flow vent assemblies being installed within one of the number of vent cutouts of the head cover portion; each user adjustable air flow vent assembly including a front vent plate and a slidable vent closure member; each front vent plate being rigidly secured to an exterior surface of the head cover portion and having a number of spaced air flow openings formed therethrough, a vent closure adjustment knob slot formed therethrough, two L-shaped vent closure member retaining slide brackets extending from an upper edge, back surface thereof, and two L-shaped vent closure member retaining slide brackets extending from a lower edge, back surface thereof; each slidable vent closure member having a plate portion slidably entrapped in connection with the front vent plate by the four L-shaped closure member retaining brackets and having a number of spaced closure plate air flow openings spaced and numbered to correspond with the spaced air flow openings of the front vent plate, and an adjustment knob extending outwardly from the plate portion through the vent closure adjustment knob slot; the adjustment knob being movable between a first position wherein the closure plate air flow openings are completely aligned with the spaced airflow openings of the front vent plate and a second position wherein the closure plate air flow openings are completely out of alignment with the spaced airflow openings of the front vent plate.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
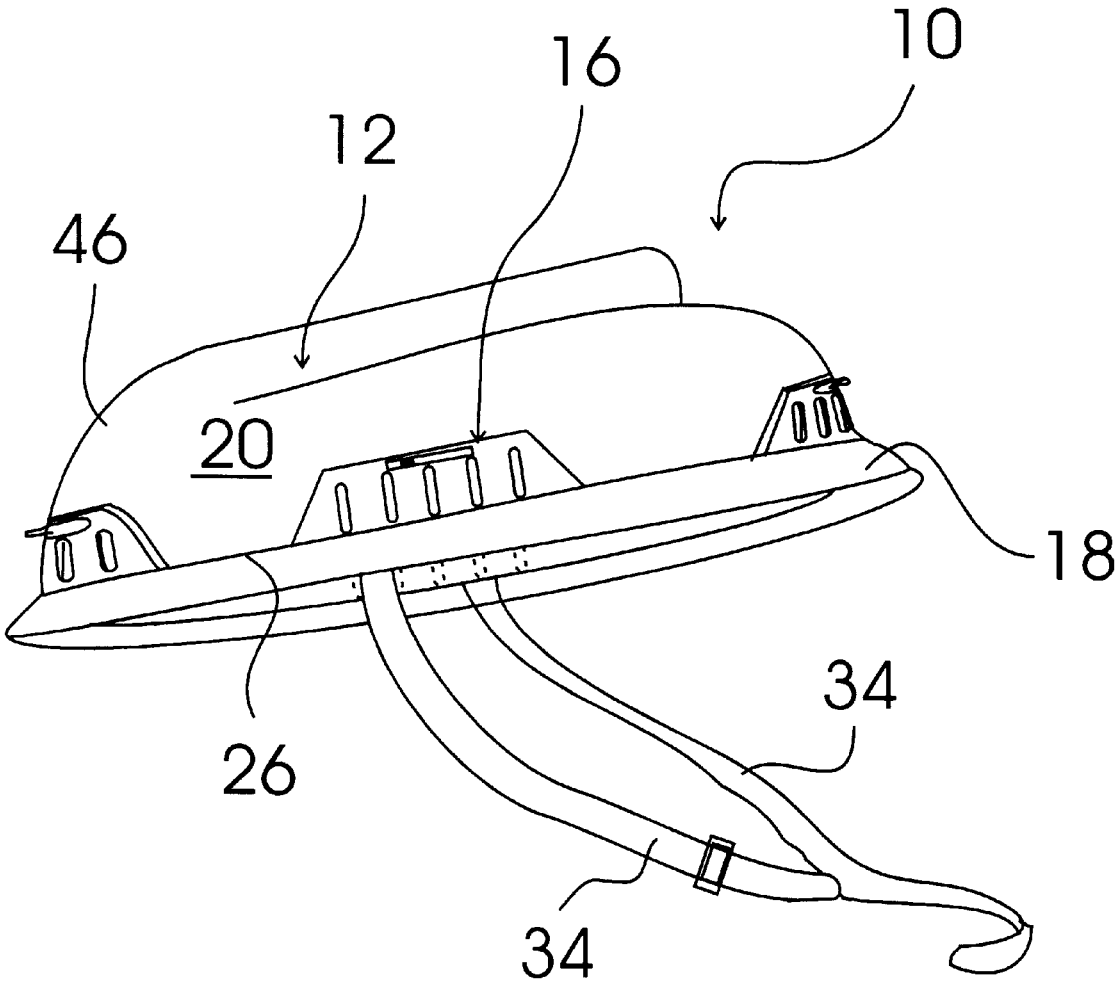
FIG. 1 is a perspective view of an exemplary embodiment of the hard hat of the present invention showing the molded, hard, phosphorescent plastic hat shell, the hat shell support harness, and four user adjustable air flow vent assemblies; the hat shell having a rim surrounding a domed shaped head cover portion having a head receiving cavity formed therein for receiving a head of a user, a number of vent cut outs formed therethrough and spaced around a bottom perimeter edge thereof adjacent to the rim; the hat shell support harness including a head crown covering harness secured to an interior surface of the head cover portion that defines the head receiving cavity and a pair of length adjustable chin straps for securing around the chin of a wearer to prevent the hard hat from being knocked off; each of the number of user adjustable air flow vent assemblies being installed within one of the number of vent cutouts of the head cover portion; each user adjustable air flow vent assembly including a front vent plate and a slidable vent closure member; each front vent plate being rigidly secured to an exterior surface of the head cover portion and having a number of spaced air flow openings formed therethrough, a vent closure adjustment knob slot formed therethrough, two L-shaped vent closure member retaining slide brackets extending from an upper edge, back surface thereof, and two L-shaped vent closure member retaining slide brackets extending from a lower edge, back surface thereof; each slidable vent closure member having a plate portion slidably entrapped in connection with the front vent plate by the four L-shaped closure member retaining brackets and having a number of spaced closure plate air flow openings spaced and numbered to correspond with the spaced air flow openings of the front vent plate, and an adjustment knob extending outwardly from the plate portion through the vent closure adjustment knob slot; the adjustment knob being movable between a first position wherein the closure plate air flow openings are completely aligned with the spaced airflow openings of the front vent plate and a second position wherein the closure plate air flow openings are completely out of alignment with the spaced airflow openings of the front vent plate.
Figure 2:
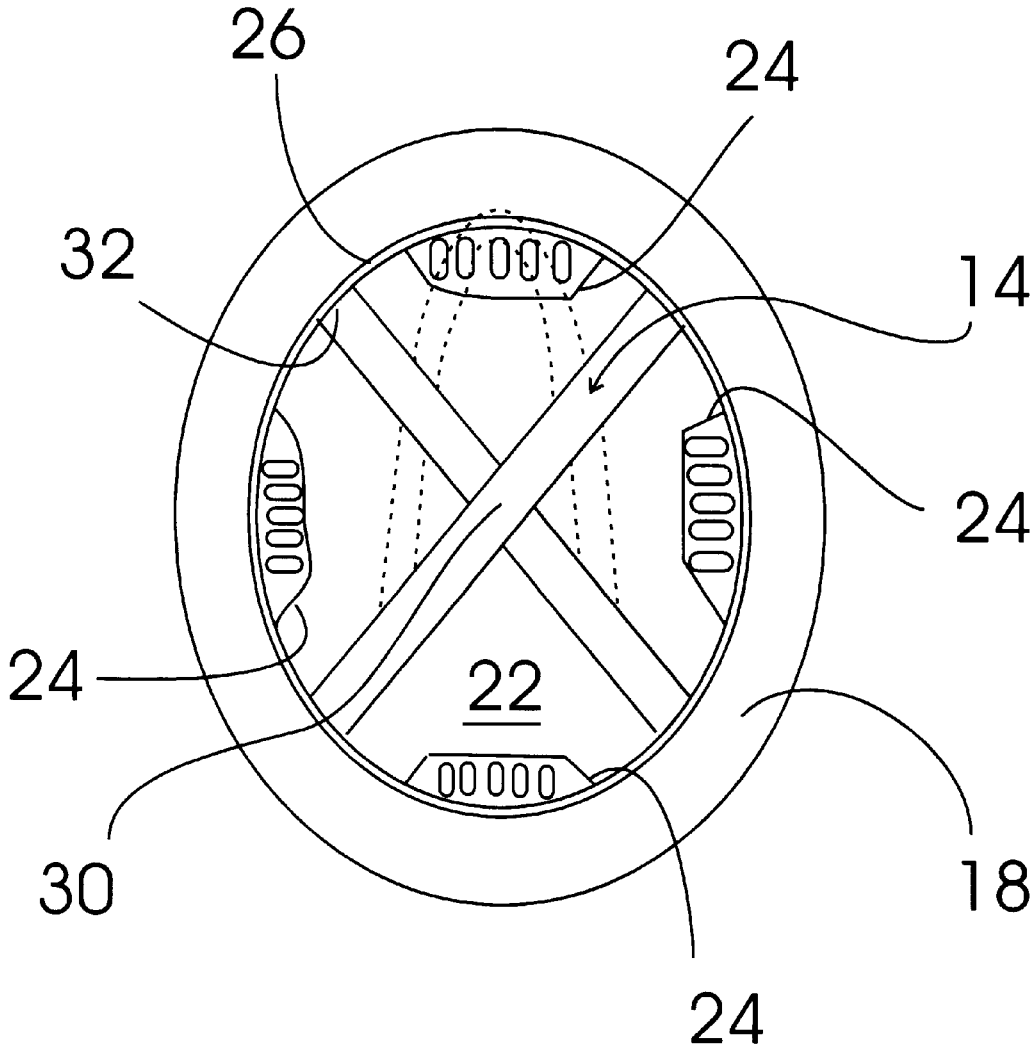
FIG. 2 is an underside plan view of the hard hat.
Figure 4:
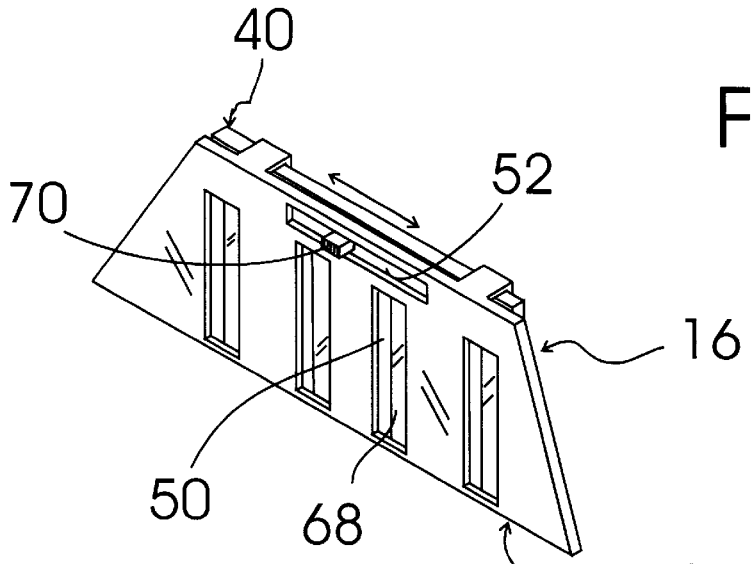
FIG. 4 is a perspective view of one of the user adjustable air flow vent assemblies in isolation.
Figure 3:
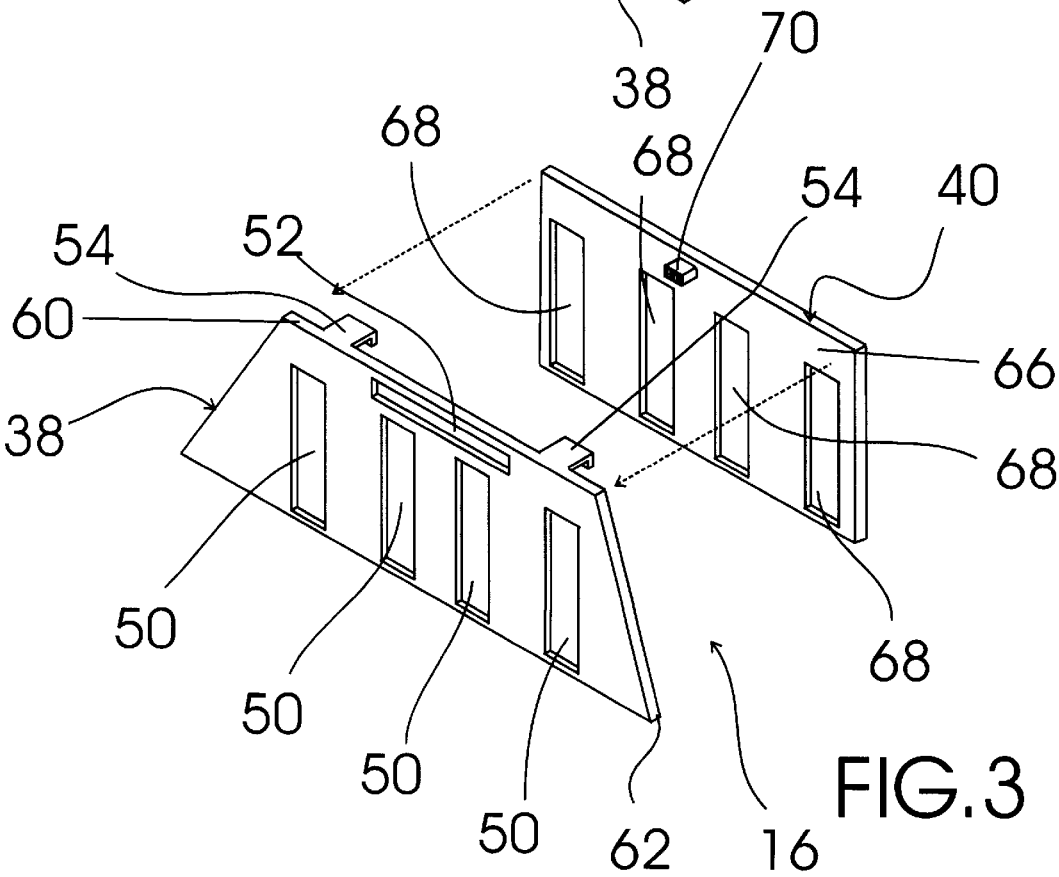
FIG. 3 is an exploded perspective view of one of the user adjustable air flow vent assemblies in isolation.

FIGS. 1–4 show various aspects of an exemplary embodiment of the hard hat of the present invention generally designated 10. Hard hat 10 includes a molded, hard, phosphorescent plastic hat shell, generally designated 12; a hat shell support harness, generally designated 14; and a number of user adjustable air flow vent assemblies, generally designated 16.

Hat shell 12 has a rim 18 surrounding a domed shaped head cover portion 20 having a head receiving cavity 22 formed therein for receiving a head of a user; and a four vent cut outs 24 formed therethrough and spaced around a bottom perimeter edge 26 thereof adjacent to rim 18. Hat shell support harness 14 includes a cross-shaped, head crown covering harness 30 secured to an interior surface 32 of head cover portion 20 that defines head receiving cavity 22 and a pair of length adjustable chin straps 34 for securing around the chin of a wearer to prevent hard hat 10 from being knocked off.

Each of the number of user adjustable air flow vent assemblies 16 is installed within one of the vent cutouts 24 of head cover portion 20. Each user adjustable air flow vent assembly 16 includes a front vent plate, generally designated 38 and a slidable vent closure member, generally designated 40. Each front vent plate 38 is rigidity secured to an exterior surface 46 of head cover portion 20 and has four spaced air flow openings 50 formed therethrough, a vent closure adjustment knob slot 52 formed therethrough, two L-shaped vent closure member retaining slide brackets 54 extending from an upper edge back surface 60 thereof, and two L-shaped vent closure member retaining slide brackets 56 (shown in dashed lines) extending from a lower edge, back surface 62 thereof. Each slidable vent closure member 40 has a plate portion 66 slidably entrapped in connection with front vent plate 38 by the four L-shaped closure member retaining brackets 54,56 and has four spaced closure plate air flow openings 68 spaced and shaped to correspond with the four spaced air flow openings 50 of front vent plate 38, and an adjustment knob 70 that extends outwardly from plate portion 66 through vent closure adjustment knob slot 52. Adjustment knob 70 is movable between a first position wherein closure plate air flow openings 68 are completely aligned with spaced airflow openings 50 of front vent plate 38 and a second position wherein closure plate air flow openings 68 are completely out of alignment with spaced airflow openings 50 of front vent plate 38.

It can be seen from the preceding description that a hard hat has been provided.

It is noted that the embodiment of the hard hat described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A hard hat comprising:

a molded, hard, phosphorescent plastic hat shell;

a hat shell support harness; and a number of user adjustable air flow vent assemblies;

said hat shell having a rim surrounding a domed shaped head cover portion having a head receiving cavity formed therein for receiving a head of a user, a number of vent cut outs equal to said number of vent assemblies formed therethrough and spaced around a bottom perimeter edge thereof adjacent to said rim;

said hat shell support harness including a head crown covering harness secured to an interior surface of said head cover portion that defines said head receiving cavity and a pair of length adjustable chin straps for securing around a chin of a wearer to prevent said hard hat from being knocked off;

each of said number of user adjustable air flow vent assemblies being installed within one of said number of vent cutouts of said head cover portion;

each user adjustable air flow vent assembly including a front vent plate and a slidable vent closure member;

each front vent plate being rigidly secured to an exterior surface of said head cover portion and having a number of spaced air flow openings formed therethrough, a vent closure adjustment knob slot formed therethrough, two L-shaped vent closure member retaining slide brackets extending from an upper edge, back surface thereof, and two L-shaped vent closure member retaining slide brackets extending from a lower edge, back surface thereof;

each slidable vent closure member having a plate portion slidably entrapped in connection with said front vent plate by said four L-shaped closure member retaining brackets and having a number of spaced closure plate air flow openings spaced and numbered to correspond with said spaced air flow openings of said front vent plate, and an adjustment knob extending outwardly from said plate portion through said vent closure adjustment knob slot;

said adjustment knob being movable between a first position wherein said closure plate air flow openings are completely aligned with said spaced airflow openings of said front vent plate and a second position wherein said closure plate air flow openings are completely out of alignment with said spaced airflow openings of said front vent plate.

* * * * *